US006293840B1

(12) United States Patent
Garofalo

(10) Patent No.: US 6,293,840 B1
(45) Date of Patent: Sep. 25, 2001

(54) INFLATABLE CHAMBER FOR HYDROSTATIC BALANCING JACKETS

(75) Inventor: Giovanni Garofalo, Rapallo (IT)

(73) Assignee: HTM Sport S.P.A. (IT)

( * ) Notice: Subject to any disclaimer, the term of this patent is extended or adjusted under 35 U.S.C. 154(b) by 0 days.

(21) Appl. No.: 09/637,113

(22) Filed: Aug. 11, 2000

(30) Foreign Application Priority Data

Oct. 27, 1999 (IT) ..... GE99A0127

(51) Int. Cl.[7] ..... B63C 9/08
(52) U.S. Cl. ..... 441/108; 441/40; 114/345
(58) Field of Search ..... 441/40, 92, 106, 441/108, 111, 112, 113, 114, 115, 90, 91; 114/345

(56) References Cited

U.S. PATENT DOCUMENTS 3,329,982 * 7/1967 Zannoni ..... 441/92

5,385,496 1/1995 Seligman .

* cited by examiner

*Primary Examiner*—Jesus D. Sotelo
(74) *Attorney, Agent, or Firm*—Larson & Taylor, PLC

(57) ABSTRACT

Inflatable chamber for hydrostatic balancing jackets, comprising two flat walls made of flexible material placed one opposite the other, connected by means of a folding wall, said wall consisting of at least two strips, each of them having its outer peripheral edge coupled with the outer peripheral edge of one of the two flat walls, and its inner peripheral edge coupled with the inner peripheral edge of the other strip; the strips of the folding wall are coupled one to the other by means of seams, sealing means being provided on said seams, particularly on the side facing the inside of said inflatable chamber.

10 Claims, 2 Drawing Sheets

Fig. E

PRIOR ART

INFLATABLE CHAMBER FOR HYDROSTATIC BALANCING JACKETS

BACKGROUND OF THE INVENTION

The present invention relates to hydrostatic balancing jackets for scuba diving, and refers in particular to an inflatable chamber for hydrostatic balancing jackets.

Balancing jackets usually consist of a back element from which two abdominal breast strips and two shoulder strips extend, the latter being connectable the ones to the others; the balancing jacket is provided with one or more inflatable chambers, usually placed on the abdominal breast strips or on the back element. Generally speaking, apart from the position of the inflatable chamber, what is highly important for the diver's convenient use is the shape said chamber takes after being inflated.

One of the solutions known from the state of the art is shown in FIG. 1A of the enclosed drawings, said solution providing the construction of the inflatable chamber by overlapping two sheets 101 made of flexible material, in which the surfaces along the respective peripheral edges 111 are tight-sealed or glued one to the other. This kind of solution, though very simple from the structural point of view, is disadvantageous from the point of view of the diver's convenience. As a matter of fact, during the inflation the chamber tends to take a substantially round shape and tends to expand against the diver's body, without being possible to re-position it.

In order to overcome this kind of problem it has been provided for balancing jackets whose inflatable chamber is obtained, as shown in FIG. 1B of the drawings, by introducing onto the peripheral edges 111 of the two sheets 101 made of flexible material a side wall 301 which can be refolded on itself when the chamber is deflated. This kind of configuration actually limits the lateral expansion of the inflatable chamber, as can be seen from figure 1C of the enclosed drawings, although it creates several structural and constructive complications, such as the fact that the folding of the side wall 301 must be strictly controlled.

The U.S. Pat. No. 5,385,496 (Seligman) discloses a balancing jacket in which the inflatable chamber, shown in a section view in FIG. 1D, comprises two flat walls 101 made of flexible material, distanced one from the other by means of a folding wall 401 consisting of two strips 411 and 421 also made of flexible material, whose outer peripheral edges 441 are connected to the outer peripheral edge 111 of one of the flat walls 101, whereas the inner peripheral edges 431 are connected one to the other. This embodiment allows the prevention of many problems occurring with the use of the structure previously described; in this case the folding of the wall 401 doesn't have to be controlled because of the presence of a bellows-shaped element guiding the expansion of the inflatable chamber, said element being able, once deflated, to gain its correct position autonomously.

However, also this kind of solution shows some drawbacks, since the connection line between the strips 411 and 421, inserted between the two flat walls 101 and constituting the folding wall 401, undergoes a consistent effort when the chamber is inflated (see FIG. 1E). In addition, said strips must be coated with a heat sealable material, such as plastics or similar material, also on the side facing the outside of the chamber. Anyway, this last contrivance too has a limited effectiveness with respect to the problems arising during manufacturing.

SUMMARY OF THE INVENTION

The present invention aims at providing a balancing jacket in which the inflatable chamber or chambers, though having a substantially bellows-shape as disclosed in the above mentioned US Patent, do not show any problems of mechanical resistance and/or sealing problems arising from said embodiment.

The object of the present invention, therefore, is an inflatable chamber for hydrostatic balancing jackets, comprising two flat walls made of flexible materials placed one opposite the other, connected by means of a folding wall, said wall consisting of at least two strips, each of them having its outer peripheral edge coupled with the outer peripheral edge of one of the two flat walls, and its inner peripheral edge coupled with the inner peripheral edge of the other strip, characterized in that the strips of the folding wall are coupled one to the other by means of seams, sealing means being provided on said seams, particularly on the side facing the inside of said inflatable chamber.

BRIEF DESCRIPTION OF THE DRAWINGS

Further advantages and characteristics will be evident from the following description of a form of embodiment of the present invention, carried out as a mere non-limiting example, with reference to the enclosed drawings, in which:

FIG. 1A to 1E are sectioned views of inflatable chamber for balancing jackets known from the art;

DESCRIPTION OF THE PREFERRED EMBODIMENT OF THE INVENTION

Figure 1:
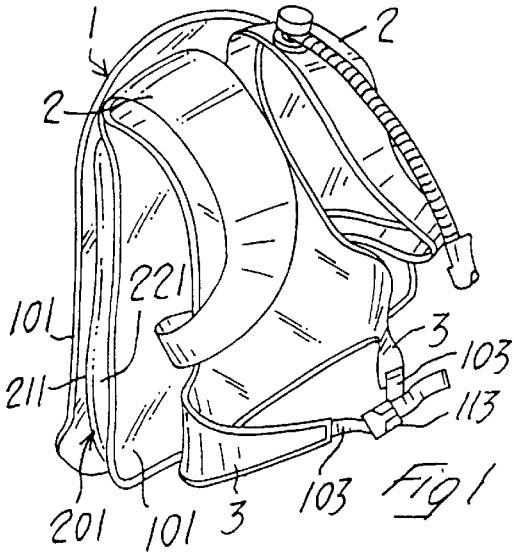
FIG. 1 is a perspective view of a balancing jacket provided with the inflatable chamber according to the present invention.
Figure 1B:
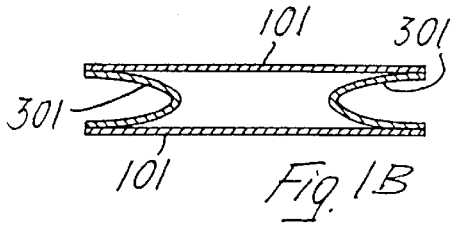
Fig. 1B PRIOR ART
Figure 1C:
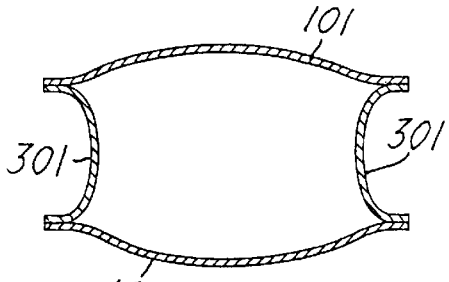
Fig. 1C PRIOR ART
Figure 1D:
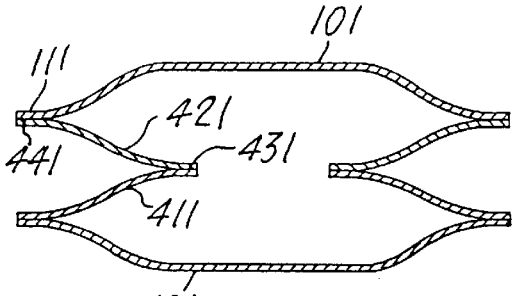
Fig. 1D PRIOR ART
Figure 1A:
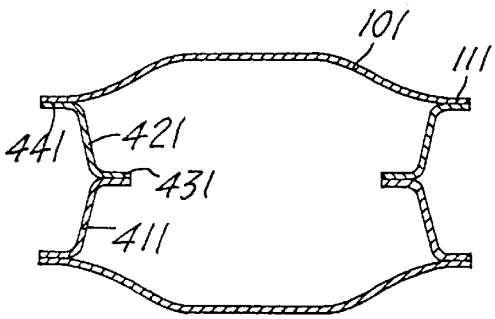
Fig. 1A PRIOR ART
Figure 1A:
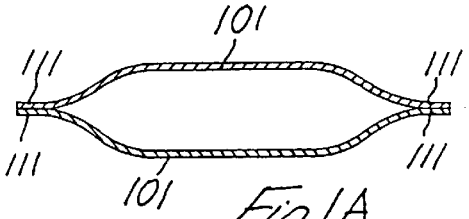
Fig. 1A PRIOR ART

FIG. 1 shows a balancing jacket; the numeral 1 refers to the back element of the jacket, from which the shoulder strips 2 and the abdominal breast strips 3 extend, said strips being connected the ones to the others by means of the belt 103 provided with a buckle 113. In this form of embodiment the inflatable chamber is carried out within the back element, and it comprises the two flat walls 101 and the folding wall 201 consisting of the two strips 211 and 221.

Figure 2:
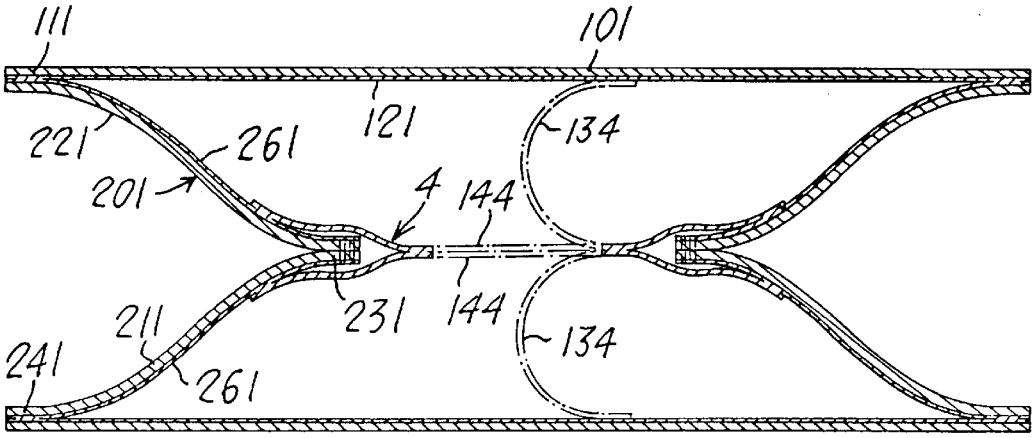
FIG. 2 is a sectioned view of the inflatable chamber of the present invention.

FIG. 2 shows a section of the inflatable chamber for balancing jackets according to the present invention; between the two flat walls 101 made of flexible material, such as natural or synthetic fiber fabric or the like, the folding wall 201 is inserted, said wall being also made of flexible material. Said wall 201 consists of two strips 211 and 221 which are connected on their outer peripheral edge 241 with the outer peripheral edge of the flat wall 101, whereas the inner peripheral edges 231 of said strips are connected one to the other. The inner side of the chamber with the flat walls 101 is provided with the coating 121, made of heat sealable plastic material, such as polyurethane or the like, in the same way as the inner side of the chamber with the strips 211 and 221 is provided with the coating 261, also made of heat sealable plastic material. At the inner peripheral edge 231 of the strips 211, 221, the sheathing 4 made of plastic material, preferably a heat sealable material such as polyurethane or the like, is connected to the coating 261 of both strips. Moreover, in the figure, a hatched line shows the connecting strips 134 extending from the sheathing 4 to the inner side of both flat walls 101, and the connecting strips 144, which connect two diametrically opposite sheathing 4 portions within the inflatable chamber.

Figure 3:
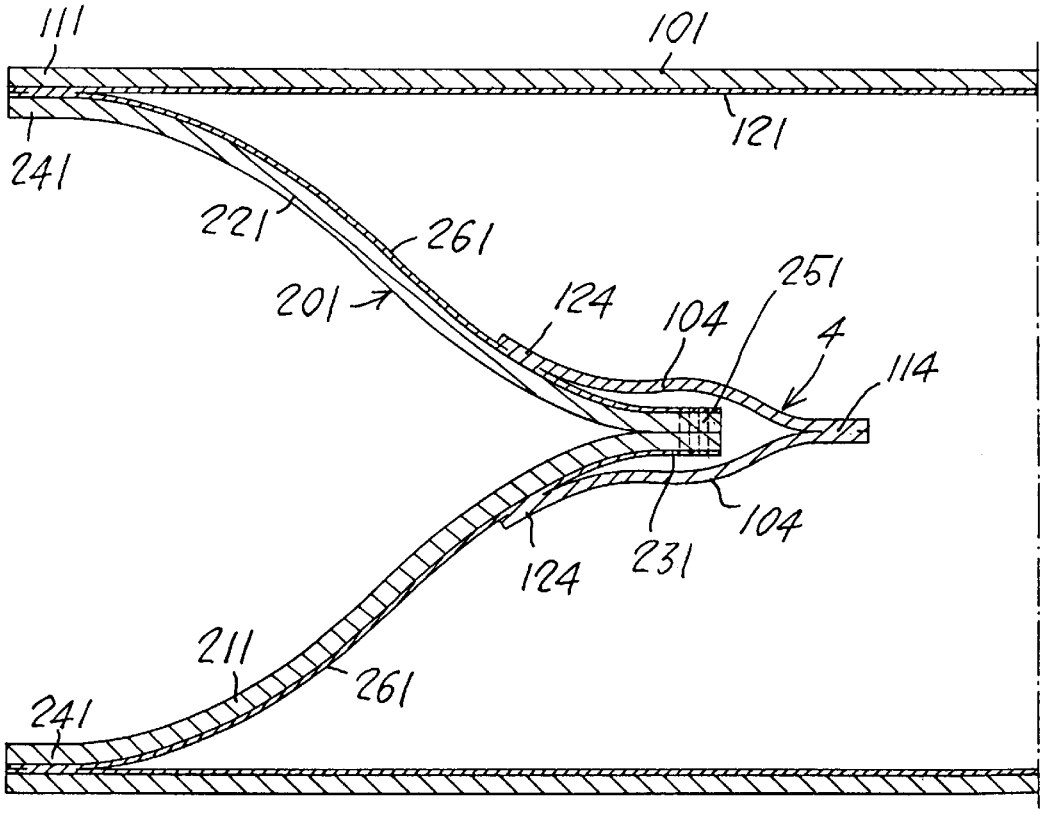
FIG. 3 is an enlarged detail of FIG. 2.

FIG. 3 shows an enlarged detail of FIG. 2; as can be observed, the peripheral edges 231 of the strips 211, 221 are connected one to the other by means of the seam 251. The sheathing 4 consists in its turn of two substantially ribbon-shaped membranes 104, joined one to the other along the edge 114, whereas their edge 124 is connected, preferably by means of heat sealing, to the coating 261 of each strip 211, 221.

The working of the jacket according to the present invention will be evident from the following. As previously mentioned, one of the problems arising from the carrying out of the inflatable chambers of balancing jackets from the previous art was connected to the pressure load which the strips forming the folding wall had to stand along their joining line, as is evident from FIG. 1E of the enclosed drawings. According to the present invention said problem is solved by providing the strips 211, 221 forming the folding wall 201 with connecting means apt to stand a very heavy load, such as for instance the seams 251. The fact that said seams cannot ensure the sealing of said chamber is easily overcome by placing the sheathing 4 on the connection between the two strips 221, 211. Said sheathing is not apt to stand any kind of effort, and can therefore be carried out as shown, that is to say, as two ribbon-shaped membranes 104 joined one to the other in 114. Obviously, the sheathing 4 can be carried out as one element connected to both strips 211, 221 of the folding wall 201.

The connecting strips 134 and/or 144 give the inflatable chamber a higher control on the deformations arising during the inflating stage, further reducing the inconveniences for the diver wearing the balancing jacket.

From the constructive point of view, the two strips 211, 221 of the folding wall 201 are first sewn one to the other, then the edge 124 of a membrane 104 is sealed onto each of both strips near the inner peripheral edge 231; then the edges 114 of both membranes 104 are sealed one to the other, thus forming the sheathing 4. Finally, the last operation consists in coupling the outer peripheral edges 241 of the strips 211, 221 with the outer peripheral edges 111 of the flat walls 101. The use of the seams 251 for the reciprocal connection of the strips 211, 221, eliminates in fact the need to coat said strips on both sides in order to allow their heat sealing.

The jacket thus conceived is provided with an inflatable chamber which can stand consistent efforts as far as inner pressure is concerned, thanks to the high mechanical resistance of the seams connecting the strips of the folding wall, without showing any drawback as far as sealing is concerned.

What is claimed is:

1. An inflatable chamber for hydrostatic balancing jackets, comprising a first and a second flat wall made of flexible material placed one opposite the other; a folding wall connecting said first and second flat walls together; said folding wall comprising at least two strips of flexible material, each of them having its outer peripheral edge coupled with the outer peripheral edge of one of the said first and second flat walls, and its inner peripheral edge coupled with the inner peripheral edge of the other of said strips; the said strips of the said folding wall being coupled one to the other by means of seams, on the side facing the inside of said chamber.

2. An inflatable chamber according to claim 1, in which said sealing means consist of a sheathing made of heat sealable plastic material placed around the inner peripheral edges of the said strips of the said folding wall.

3. An inflatable chamber according to claim 2, in which said sheathing consists of two substantially ribbon-shaped membranes, connected one to the other along a side edge, the other side edge being connected to each of the said two strips of the said folding wall near the inner peripheral edge of said strip.

4. An inflatable chamber according to claim 2, in which from said sheathing two or more connecting strips extend, said strips being connected on their other end to the inner surface of both said first and second flat walls.

5. An inflatable chamber according to claim 4, in which two or more diametrically opposite portions of said sheathing are reciprocally connected by means of one or more of said connecting strips.

6. An inflatable chamber according to claim 5, in which said first and second flat walls and said folding wall are covered with a coat of heat sealable plastic material on the side facing the inside of said inflatable chamber.

7. An inflatable chamber according to claim 6, in which said coat of plastic material is made of a heat sealable plastics material.

8. An inflatable chamber according to claim 7, in which said coat of plastic material is made of polyurethane.

9. An inflatable chamber according to claim 2, in which said sheathing is made of a heat sealable plastics material.

10. An inflatable chamber according to claim 9, in which said sheathing is made of polyurethane.

* * * * *